US008205750B2

(12) United States Patent
Kim

(10) Patent No.: US 8,205,750 B2
(45) Date of Patent: Jun. 26, 2012

(54) BUFFER PACKING MATERIAL HAVING AIR INJECTION PATH FORMED WITH BYPASS AND METHOD FOR MANUFACTURING THE SAME

(75) Inventor: Young Soo Kim, Hanam-si (KR)

(73) Assignee: RECO Co., Ltd., Siheung-si (KR)

( * ) Notice: Subject to any disclaimer, the term of this patent is extended or adjusted under 35 U.S.C. 154(b) by 0 days.

(21) Appl. No.: 13/133,148

(22) PCT Filed: Mar. 11, 2010

(86) PCT No.: PCT/KR2010/001531

§ 371 (c)(1),
(2), (4) Date: Aug. 9, 2011

(87) PCT Pub. No.: WO2010/150967

PCT Pub. Date: Dec. 29, 2010

(65) Prior Publication Data

US 2011/0300320 A1 Dec. 8, 2011

(30) Foreign Application Priority Data

Jun. 23, 2009 (KR) ..... 10-2009-0056076

(51) Int. Cl.
*B32B 1/08* (2006.01)

(52) U.S. Cl. ..... 206/522

(58) Field of Classification Search ..... 206/522, 206/521; 383/3

See application file for complete search history.

(56) References Cited

U.S. PATENT DOCUMENTS 5,769,232 A * 6/1998 Cash et al. ..... 206/522
2008/0080792 A1 * 4/2008 Liao et al. ..... 383/3

FOREIGN PATENT DOCUMENTS

JP 1996-034478 A 2/1996
JP 2005-162268 A 6/2005
KR 10-2007-0090758 A 9/2007
KR 10-2008-0029755 A 4/2008

OTHER PUBLICATIONS

International Search Report mailed Sep. 30, 2010, issued in International Application No. PCT/KR2010/001531, filed Mar. 11, 2010, 2 pages.

* cited by examiner

*Primary Examiner* — Steven A. Reynolds
*Assistant Examiner* — King M Chu
(74) *Attorney, Agent, or Firm* — Christensen O'Connor Johnson Kindness PLLC

(57) ABSTRACT

The present invention relates to a buffer packing material having an air injection path formed with a bypass, and more particularly, to a buffer packing material, in which a bypass is formed at one side of a passage between an air injection path for injecting air from the outside and an air guiding path for guiding the injected air into an air cell and in communication with the outside so as to prevent a specific air cell from being deformed or broken by an excessive air injected into the specific air cell due to an increased pressure in the air injection path when air is injected into the cell, and a method for manufacturing the same.

8 Claims, 8 Drawing Sheets

BUFFER PACKING MATERIAL HAVING AIR INJECTION PATH FORMED WITH BYPASS AND METHOD FOR MANUFACTURING THE SAME

TECHNICAL FIELD

The present invention relates to a buffer packing material having an air injection path formed with a bypass and a method for manufacturing the same, and more particularly, to a buffer packing material, in which a bypass is formed at one side of a passage between an air injection path for injecting air from the outside and an air guiding path for guiding the injected air into an air cell and in communication with the outside so as to prevent a specific air cell from being deformed or broken by an excessive air injected into the specific air cell due to an increased pressure in the air injection path when air is injected into the cell, and a method for manufacturing the same.

BACKGROUND ART

Generally, when a product such as an electronic product is packaged in a box, a buffer material such as Styrofoam has been frequently used to prevent the product from being broken or damaged by an external impact or an internal vibration.

However, such a buffer material has a great volume, which deteriorates the effective spatial utilization and increases costs during a distribution process, for example when being stored, piled up or carried. In addition, the buffer material is not recycled but wasted as it is after usage, which causes environmental pollution. As mentioned above, the buffer material has many problems.

Therefore, a buffer packing material having air cells formed therein by fusing a plurality of plastic films or sheets and filled with air to expand is used instead of Styrofoam.

In this buffer material, a pair of inner sheets having a plurality of air guiding paths are interposed between a pair of outer sheets by using a releasing band, and the pair of outer sheets and the pair of inner sheets are fused with each other to form a plurality of air cells, each of which has one air guiding path. Here, air is injected into an air injection path, which is formed by fusion and communicates with the plurality of air guiding paths, so that the plurality of air cells expands, thereby allowing the buffer material to be used.

In more detail, the overlapping upper and lower, outer and inner sheets are fused at regular intervals in a length direction to form a vertical fusion portion. Subsequently, the rear end of the upper and lower outer sheets is fused in a transverse direction to form a rear end transverse fusion portion, and the front ends of the upper and lower outer sheets and the upper and lower inner sheets are integrally fused to form a front end transverse fusion portion. At this time, a releasing band is formed in a transverse direction between the upper inner sheet and the lower inner sheet at the front end transverse fusion portion which is in contact with the end of the longitudinal fusion portion, so that a region having the releasing band formed is configured not to be fused. In this way, the air injected through the air injection path is injected into the air cells formed by the upper and lower outer sheets at regular intervals through the air guiding paths formed between the upper and lower inner sheets in the non-fused region as a passage.

With this configuration, if air is injected through the air injection path, the air cells are filled with air via the air guiding paths. In addition, if each air cell is sufficiently filled with air, the upper inner sheet and the lower inner sheet become into close contact with each other due to the pressure of the air filled in the air cell to close the air guiding path, so that the air in the air cells are not discharged to the outside.

However, the conventional buffer packing material as described above has no exit for the injected air when air is injected into the plurality of air cells through the air injection path at the same time. For this reason, if the internal pressure of the air injection path excessively increases, the air may be excessively injected into a certain air cell. In this case, the internal pressure of the corresponding air cell increases so that the outer sheet of the air cell is stretched and deformed. Therefore, there are problems in that it is difficult to put the product into a box of a certain shape, or the outer sheet or the fusion portion may be fractured to loss its buffer function.

DISCLOSURE

Technical Problem

The present invention is conceived to solve the aforementioned problems. An object of the present invention is to provide a buffer packing material having an air injection path formed with a bypass, wherein the bypass is formed at one side of a passage between an air injection path for injecting air from the outside and an air guiding path for guiding the injected air into an air cell and in communication with the outside so as to prevent a specific air cell from being deformed or broken by an excessive air injected into the specific air cell due to an increased pressure in the air injection path when air is injected into the cell, and a method for manufacturing the same.

Technical Solution

A buffer packing material having an air injection path formed with a bypass according to the present invention comprises a lower outer sheet; a lower inner sheet overlapping with an upper portion of the lower outer sheet so that a releasing band is formed in an upper portion of the lower inner sheet in a transverse direction along a front edge thereof; an upper inner sheet overlapping with the upper portion of the lower inner sheet and partially fused with the lower inner sheet to form a plurality of air guiding paths; and an upper outer sheet overlapping with the upper portions of the upper inner sheet and the lower outer sheet and partially fused with the upper inner sheet, the lower inner sheet and the lower outer sheet to form a plurality of air cells so that the air cells respectively have a plurality of air guiding paths and simultaneously to form an air injection path at front ends of the plurality of air cells so that the air injection path communicates with the air guiding paths, wherein the releasing band formed at the front end of the upper portion of the lower inner sheet is configured to define passages, the passages being formed at positions where the air injection path is connected to the air guiding paths between the air injection path and the air cells so that the air injection path communicates with the air guiding paths, and to define a bypass so that the bypass allows the passages, through which the air injection path communicates with the air guiding paths, to communicate with each other, one end of the bypass communicating with the outside, whereby if air is excessively injected into the air injection path, the overpressure air in the air injection path is discharged to the outside through the bypass to control an internal pressure of the air injection path.

A method for manufacturing a buffer packing material having an air injection path formed with a bypass according to the present invention comprises the steps of forming a releasing band along a front edge of an upper portion of a lower inner sheet; overlapping an upper inner sheet on the lower inner sheet and inserting the upper inner sheet and the lower inner sheet between an upper outer sheet and a lower outer sheet; inserting a releasing sheet between the lower inner sheet and the lower outer sheet and partially fusing the upper outer sheet, the upper inner sheet, and the lower inner sheet to form a plurality of air guiding paths; removing the releasing sheet; partially fusing the upper outer sheet, the upper inner sheet, the lower inner sheet, and the lower outer sheet to form a plurality of air cells so that each air cell has one air guiding path and to form an air injection path at front ends of the plurality of air cells to communicate with the plurality of air guiding paths, and a bypass is formed which connects passages by passing through the passages, the passages allowing the air injection path to communicate with the plurality of air guiding paths, the bypass having an end communicating with the outside; and injecting air into the air injection path so that the plurality of air cells are filled with air through the air guiding paths, wherein, if an internal pressure of the air injection path is excessively increased due to the air injected into the air injection path, the overpressure air is discharged to the outside through the bypass.

Also, a method for manufacturing a buffer packing material having an air injection path formed with a bypass according to the present invention comprises the steps of: forming a pair of releasing bands spaced apart by a predetermined distance along an upper center of a lower inner sheet; overlapping an upper inner sheet on the lower inner sheet and inserting the upper inner sheet and the lower inner sheet between an upper outer sheet and a lower outer sheet while cutting a central portion of the upper inner sheet and the lower inner sheet; inserting a releasing sheet between the lower inner sheet and the lower outer sheet and partially fusing the upper outer sheet and the pair of cut upper and lower inner sheets to form air guiding paths respectively between the pair of cut upper and lower inner sheets; removing the releasing sheet; partially fusing the upper outer sheet, the upper inner sheet, the lower inner sheet, and the lower outer sheet to form a plurality of air cells so that each air cell has one air guiding path and to form an air injection path at front ends of the plurality of air cells to communicate with the plurality of air guiding paths, and a bypass is formed which connects passages by passing through the passages, the passages allowing the air injection path to communicate with the plurality of air guiding paths, the bypass having an end communicating with the outside; and injecting air into the air injection path so that the plurality of air cells are filled with air through the air guiding paths, wherein, if an internal pressure of the air injection path is excessively increased due to the air injected into the air injection path, the overpressure air is discharged to the outside through the bypass.

Advantageous Effects

The buffer packing material having an air injection path formed with a bypass according to the present invention may prevent its external appearance from being deformed or broken by an excessive air injected into a specific air cell by forming a bypass communicating with the outside at one side of a passage between an air injection path for injecting air from the outside and an air guiding path for introducing the injected air into the air cell to discharge overpressure air introduced into the air cell to the outside.

In addition, according to a method for manufacturing a buffer packing material having an air injection path formed with a bypass of the present invention, in a structure in which a plurality of air cells are formed to correspond to each other with respect to the air injection path, a central portion of upper and lower outer sheets in which a pair of releasing bands are formed in parallel is cut just before the pair of releasing bands are inserted between the upper and lower sheets, so that the releasing bands can be aligned at a correct location where the air cell is formed, thereby reducing a defect rate.

Figure 1:
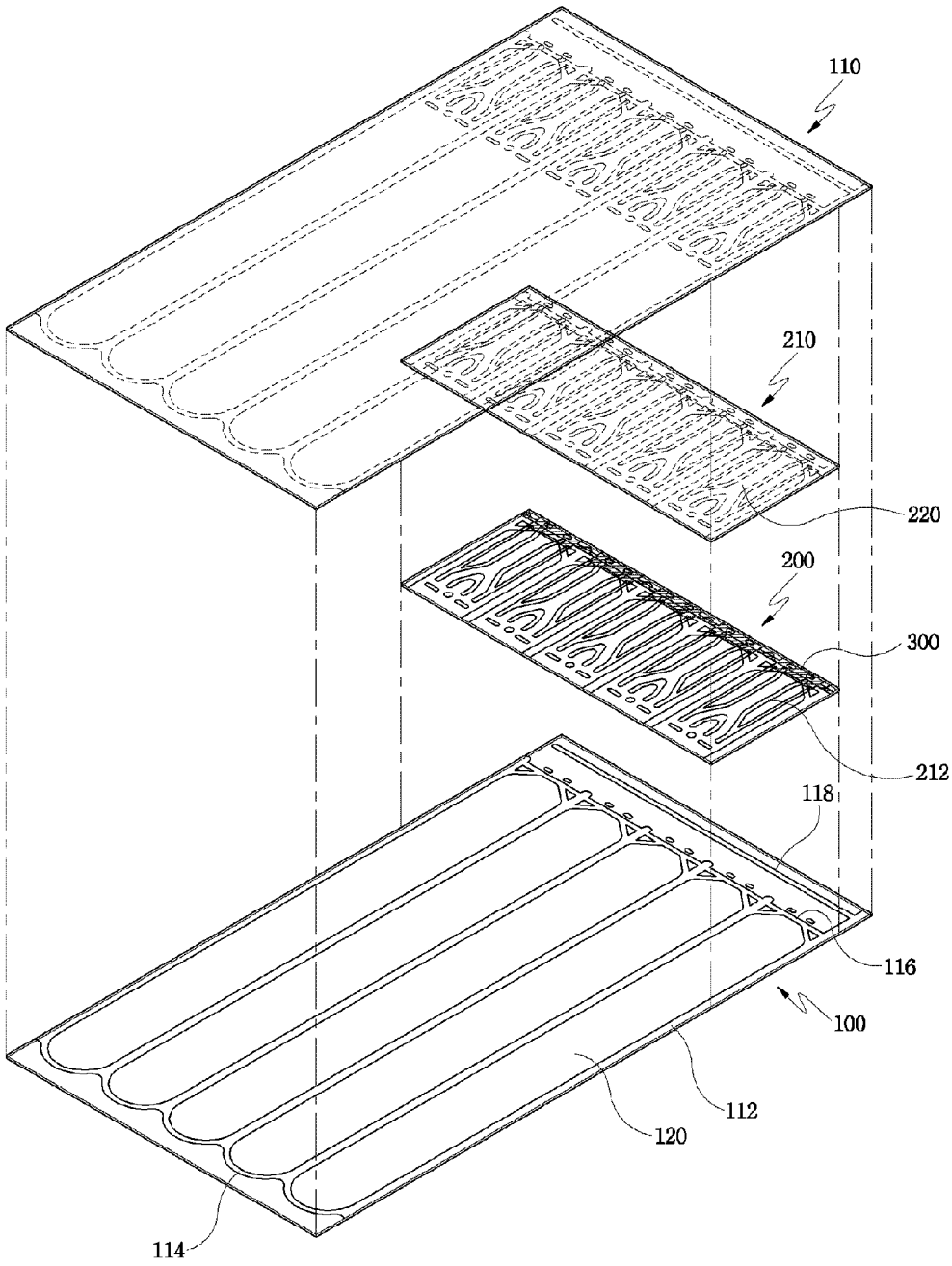
FIG. 1 is an exploded perspective view showing a buffer packing material having an air injection path formed with a bypass according to a first embodiment of the present invention.

[Explanation of Reference Numerals for Major Portions Shown in Drawings]

| | | | |
|---|---|---|---|
| 100: | Lower outer sheet | 110: | Upper outer sheet |
| 112: | Longitudinal fusion portion | 114: | First transverse fusion portion |
| 116: | Second transverse fusion portion | 118: | Third transverse fusion portion |
| 120: | Air cell | 140: | Air injection path |
| 142: | Air injection hole | 150: | Bypass |
| 200: | Lower inner sheet | 210: | Upper inner sheet |
| 220: | Air guiding path | 300: | Releasing band |

BEST MODE

Hereinafter, preferred embodiments of the present invention will be described in more detail. However, the present invention is not limited to the preferred embodiments thereof set forth herein without departing from the essential features of the invention.

Figure 2:
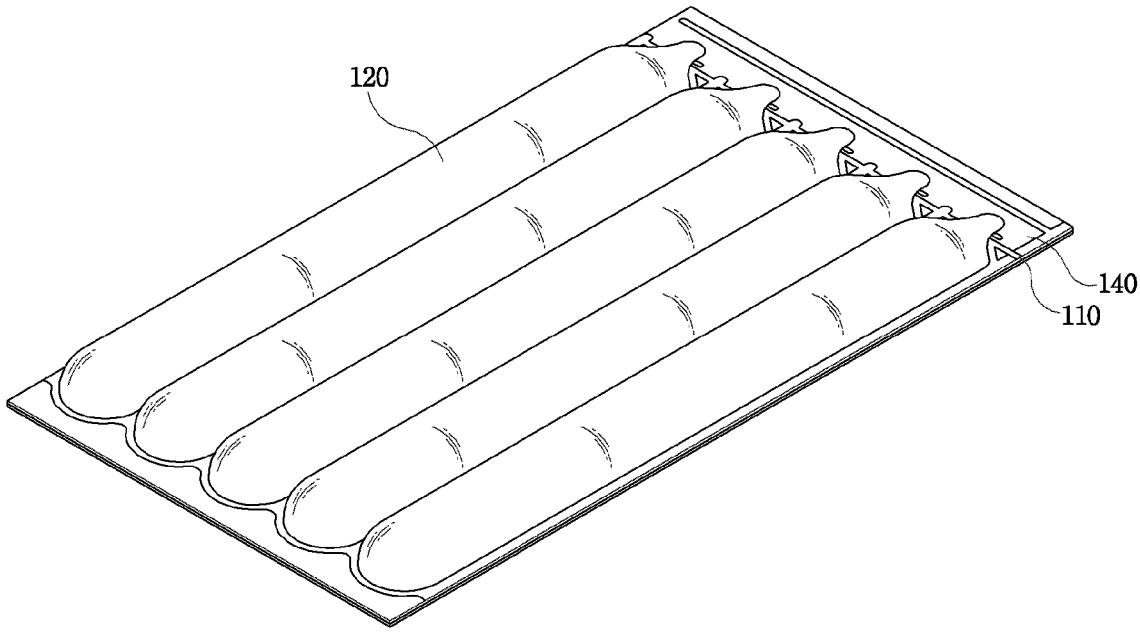
FIG. 2 is a perspective view showing the buffer packing material having an air injection path formed with a bypass according to the first embodiment of the present invention.
Figure 3:
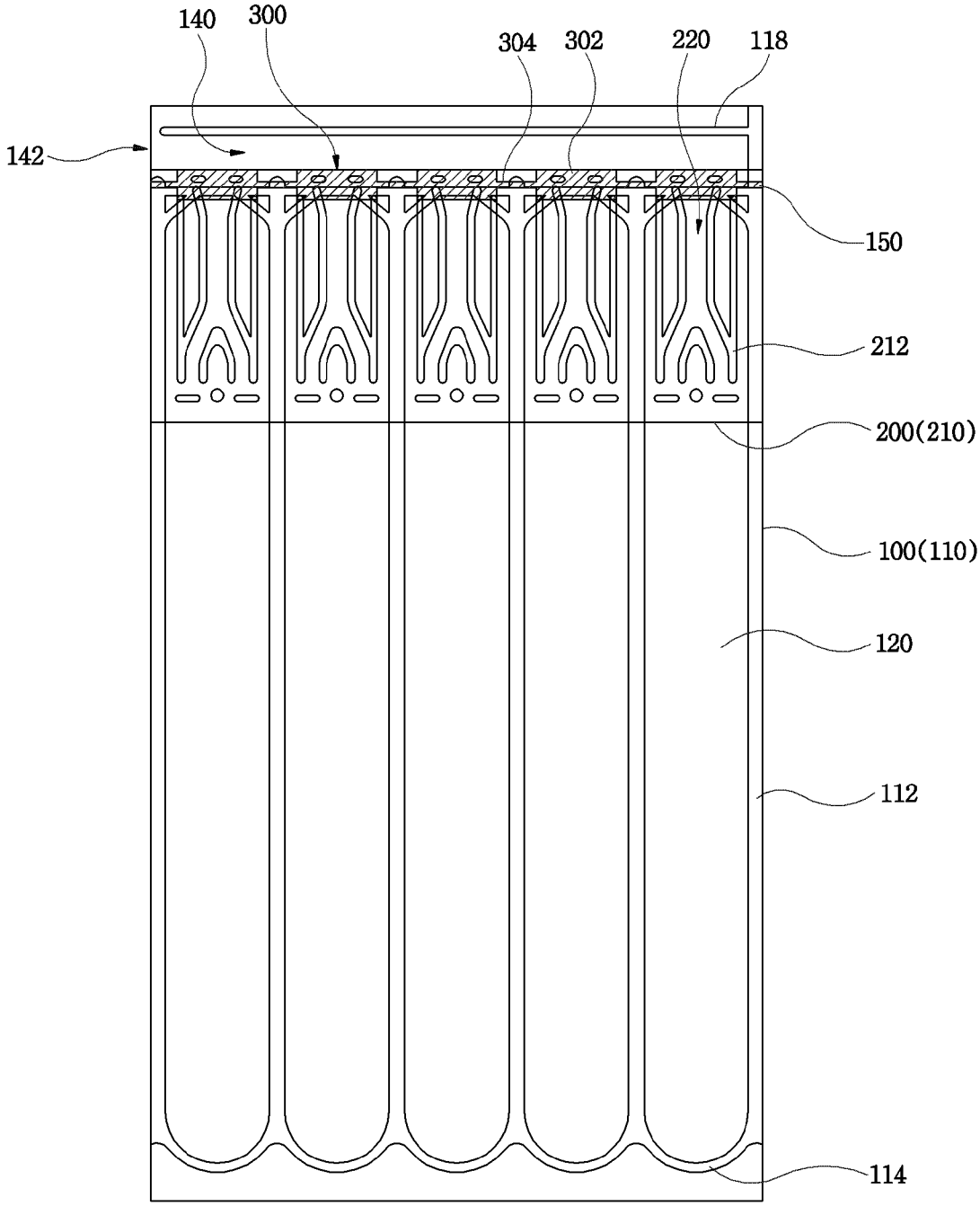
FIG. 3 is a plan view showing the buffer packing material having an air injection path formed with a bypass according to the first embodiment of the present invention.
Figure 4:
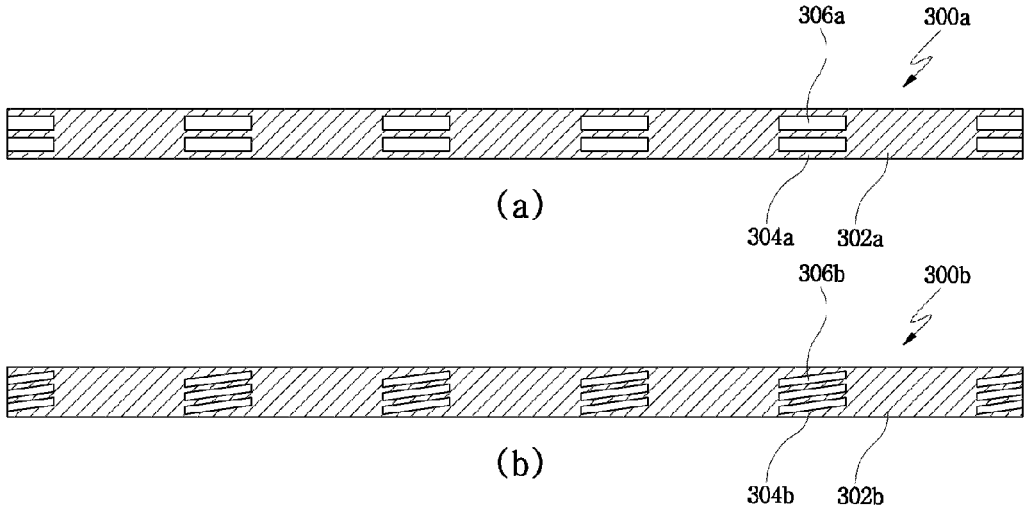
FIG. 4 is a plan view showing a modification of a releasing band of the buffer packing material having an air injection path formed with a bypass according to the first embodiment of the present invention.

FIG. 1 is an exploded perspective view showing a buffer packing material having an air injection path formed with a bypass according to a first embodiment of the present invention; FIG. 2 is a perspective view showing the buffer packing material having an air injection path formed with a bypass according to the first embodiment of the present invention; FIG. 3 is a plan view showing the buffer packing material having an air injection path formed with a bypass according to the first embodiment of the present invention; and FIG. 4 is a plan view showing a modification of a releasing band of the buffer packing material having an air injection path formed with a bypass according to the first embodiment of the present invention.

Although a plurality of air cells are divided from each other and successively formed in a transverse direction in the figures, only one of the air cells will be described below.

The terms "upper," "lower," "front," and "rear" used herein are selected based on the figures for easy understanding of the present invention. In other words, in the buffer packing material shown in FIG. 1, according to a laminating order of outer and inner sheets, a sheet located at a lower side is called a lower sheet, and a sheet located at an upper side is called an upper sheet. In addition, as shown in FIG. 3, an upper end of the air cell is called a front end, and a lower end of the air cell is called a rear end.

In the figures, a direction along a shorter side of the air cell is called a transverse direction, and a direction along a longer side of the air cell is called a longitudinal direction. In addition, a solid line shown in the sheet represents a fusion portion formed at an upper surface of the sheet, and a dotted line represents a fusion portion formed at a bottom surface of the sheet.

Referring to FIGS. 1 to 3, a buffer packing material having an air injection path formed with a bypass according to the present invention includes a lower outer sheet 100; a lower inner sheet 200 overlapping with an upper portion of the lower outer sheet 100 so that a releasing band 300 is formed in an upper portion of the lower inner sheet in a transverse direction along a front edge thereof; an upper inner sheet 210 overlapping with the upper portion of the lower inner sheet 200 and partially fused with the lower inner sheet 200 to form a plurality of air guiding paths 220; and an upper outer sheet 110 overlapping with the upper portions of the upper inner sheet 210 and the lower outer sheet 200 and partially fused with the upper inner sheet 210, the lower inner sheet 200 and the lower outer sheet 100 to form a plurality of air cells 120 so that the air cells 120 respectively have a plurality of air guiding paths 220 and simultaneously to form an air injection path 140 at front ends of the plurality of air cells 120 so that the air injection path 140 communicates with the air guiding paths 220. At this time, the releasing band 300 formed at the front end of the upper portion of the lower inner sheet 200 is configured to define passages, which are formed at positions where the air injection path 140 is connected to the air guiding paths 220 between the air injection path 140 and the air cells 120 so that the air injection path 140 communicates with the air guiding paths 220. Also, the releasing band 300 is configured to define a bypass 150 so that the bypass allows the passages, through which the air injection path 140 communicates with the air guiding paths 220, to communicate with each other and one end of the bypass 150 communicates with the outside. The bypass 150 formed as above discharges a part of overpressure air to the outside and controls an internal pressure of the air injection path 140 when the internal pressure of the air injection path 140 excessively increases.

For this purpose, the releasing band 300 may be formed to have a suitable pattern according to its aim, and a detailed shape of the releasing band 300 will be described later in detail.

The lower outer sheet 100 and the upper outer sheet 110 are made of a synthetic resin film, such as high density polyethylene (hard polyethylene), nylon, and PET (polyethylene-terephthalate), which allows excellent recycling, and have the same size.

At this time, an anti-rust material for controlling the generation of rust of an article to be packaged or an anti-charging material for preventing the generation of static electricity may be added to the films of the lower outer sheet 100 and the upper outer sheet 110. In other case, an anti-rust film containing an anti-rust material or an anti-charging film containing an anti-charging material may be laminated to one surface or both surfaces of each of the lower outer sheet 100 and the upper outer sheet 110.

The lower inner sheet 200 and the upper inner sheet 210 are also made of a film, such as a synthetic resin film, and are formed to have the same length as the lower outer sheet 100 and the upper outer sheet 110 in a transverse direction and a shorter length than the lower outer sheet 100 and the upper outer sheet 110 in a transverse direction.

The releasing band 300 is made of a material with heat resistance. The releasing band 300 is formed along the front edge of the upper portion of the lower inner sheet 200 and has a pattern in which wide areas 302 and narrow areas 304 are repeatedly alternated.

In more detail, the releasing band 300 is formed in the pattern in which the rectangular patterns 302 defining the passages at positions where the air injection path 140 is connected to the air guiding paths 220 and the narrow strip patterns 304 defining the bypass 150 by connecting the rectangular patterns 302 to each other are repeated alternated. Although the wide area 302 of the releasing band 300 is illustrated as the rectangular pattern 302, the wide area 302 may be formed to have various shapes such as a circular shape, an oval shape or a polygonal shape. In addition, the narrow area 304 may also be formed to have various shapes such as a straight shape or a curved shape.

In this configuration, the releasing band 300 prevents the lower inner sheet 200 and the upper inner sheet 210 from being fused to each other when a fusing process is performed for the upper and lower inner sheets 210 and 200. In addition, the regions where the rectangular patterns 302 are formed become the passages which connect the air injection path 140 to the air guiding paths 220, and the regions where the narrow strip patterns 304 are formed become the bypass 150 to discharge the overpressure air introduced into the air cells 120 to the outside through the passages between the air guiding paths 220.

The releasing band 300 as described above may be formed to have various shapes. As shown in FIG. 4, through-holes 306*a* or 306*b* with various shapes may be formed at regular intervals in a releasing band 300*a* or 300*b* in the shape of a bar, so that the regions 302*a* or 302*b* where the through-holes are not formed become passages for allowing the air injection path 140 to communicate with the air guiding paths 220 and the regions 302*a* or 302*b* where the plurality of through-holes are formed become the bypass 150 for allowing the passages to communicate with each other. The size of the bypass 150 may vary according to the size or number of the through-holes.

The aforementioned components define the air cells, the air injection path, the air guiding paths, and the bypass through several fusing processes, their configuration and a manufacturing method of a buffer packing material are as follows.

The releasing band 300 is formed along the front edge of the upper portion of the lower inner sheet 200, and the upper inner sheet 210 and the lower inner sheet 200 are disposed to overlap.

Then, the overlapping upper and lower inner sheets 210 and 200 are inserted between the overlapping upper and lower outer sheets 110 and 100. Thereafter, a releasing sheet (not shown in the drawing) is inserted between the lower inner sheet 200 and the lower outer sheet 100, and the upper outer sheet 110, the upper inner sheet 210, and the lower inner sheet 200 are partially fused at regular intervals in a longitudinal direction by using a mold so that inner fusion portions 212 are formed to fuse the upper outer sheet 110 and the upper inner sheet 210 to each other and the air guiding paths 220 are formed between the upper inner sheet 210 and the lower inner sheet 200. At this time, the passages connecting the air injection path 140 to the air guiding paths 220 are formed at portions, where the releasing band 300 is formed, in the inner fusion portions 212.

After the air guiding paths 220 are formed, the releasing sheet is removed, and the upper and lower outer sheets 110 and 100 and the upper and lower inner sheets 210 and 200 are moved to a mold for forming the air cells and the air injection path.

Thereafter, the upper and lower outer sheets 110 and 100 and the upper and lower inner sheets 210 and 200 are fused together using the mold for forming the air cells and the air injection path to form longitudinal fusion portions 112 at regular intervals. A first transverse fusion portion 114 connecting rear ends of the longitudinal fusion portions 112 is formed at the rear ends of the longitudinal fusion portions 112. A second transverse fusion portion 116 connecting front ends of the longitudinal fusion portions 112 is formed at the front ends of the longitudinal fusion portions 112. At this time, the front ends of the longitudinal fusion portions 112 are formed at locations spaced apart from the front edges of the upper and lower outer sheets 110 and 100, namely at locations where the releasing band 300 is formed, and the plurality of air cells 120 are formed in series in a transverse direction by means of the longitudinal fusion portions 112 and the first and second transverse fusion portions 114 and 116.

In addition, during the fusing process, a third transverse fusion portion 118 is formed along the front end of the second transverse fusion portion 116, namely along the upper edges of the upper and lower outer sheets 110 and 100, and the third transverse fusion portion 118 defines the air injection path 140 together with the second transverse fusion portion 116. The air injection path 140 formed as above has an air injection hole 142 opened at one side thereof so that air may be injected through the air injection hole. The other side of the air injection path 140 may be closed by extending the longitudinal fusion portion 112, or formed to be open and then fused later as necessary by an additional fusing process.

In this configuration, the bypass 150 communicating with the outside is formed at the regions of the narrow strip patterns 304 connecting the passages which connect the air injection path 140 to the air guiding paths 220 in the regions of the rectangular patterns 302. When air injected into the air injection path 140 is introduced into the air cells 120 through the air guiding paths 220, the bypass 150 discharges overpressure air to the outside.

In other words, the bypass 150 connects the passages by passing through the passages, which allow the air injection path 140 to communicate with the plurality of air guiding paths 220, at locations where the air injection path 140 is connected to the air guiding paths 220 between the air injection path 140 and the air cells 120. Also, the bypass 150 has one end communicating with the outside. Therefore, when the air pressure in the air injection path 140 excessively increases, considering that air is continuously injected into the air cell 120 that is already sufficiently filled with air, the air injected into the air cell 120 is discharged to the outside through the bypass 150 to somewhat lower the pressure in the air injection path 140, so that air is prevented from being injected into the air cell 120, which is already sufficiently filled with air and has high pressure, any more. Accordingly, it is possible to prevent air from being excessively injected into a specific air cell 120 and thus to prevent the outer sheets 100 and 110 from being deformed or broken.

In addition, if the bypass 150 formed as above has an excessively great width, the amount of air discharged out through the bypass 150 is greater than needs to thereby deteriorate the work efficiency. If the bypass 150 has an excessively small width, the amount of air discharged out is too extremely limited to thereby deteriorate the effect of reducing the overpressure in the air injection path 140. Thus, the width of the bypass 150 should be suitably adjusted. After forming the bypass 150 with various sizes, it was found from test results that the desirable width of the bypass 150 is 0.1% to 20% of the width of the air injection path 140.

In addition, if the air cell 120 is sufficiently filled with air and then air is not injected into the air cell 120 any more, the upper and lower inner sheets 210 and 200 which define the air guiding paths 220 are brought into close contact with the upper outer sheet 110 due to the internal air pressure in a state where the upper and lower inner sheets 210 and 200 are sealed, so that the air in the air cell 120 is not discharged to the outside.

Figure 5:
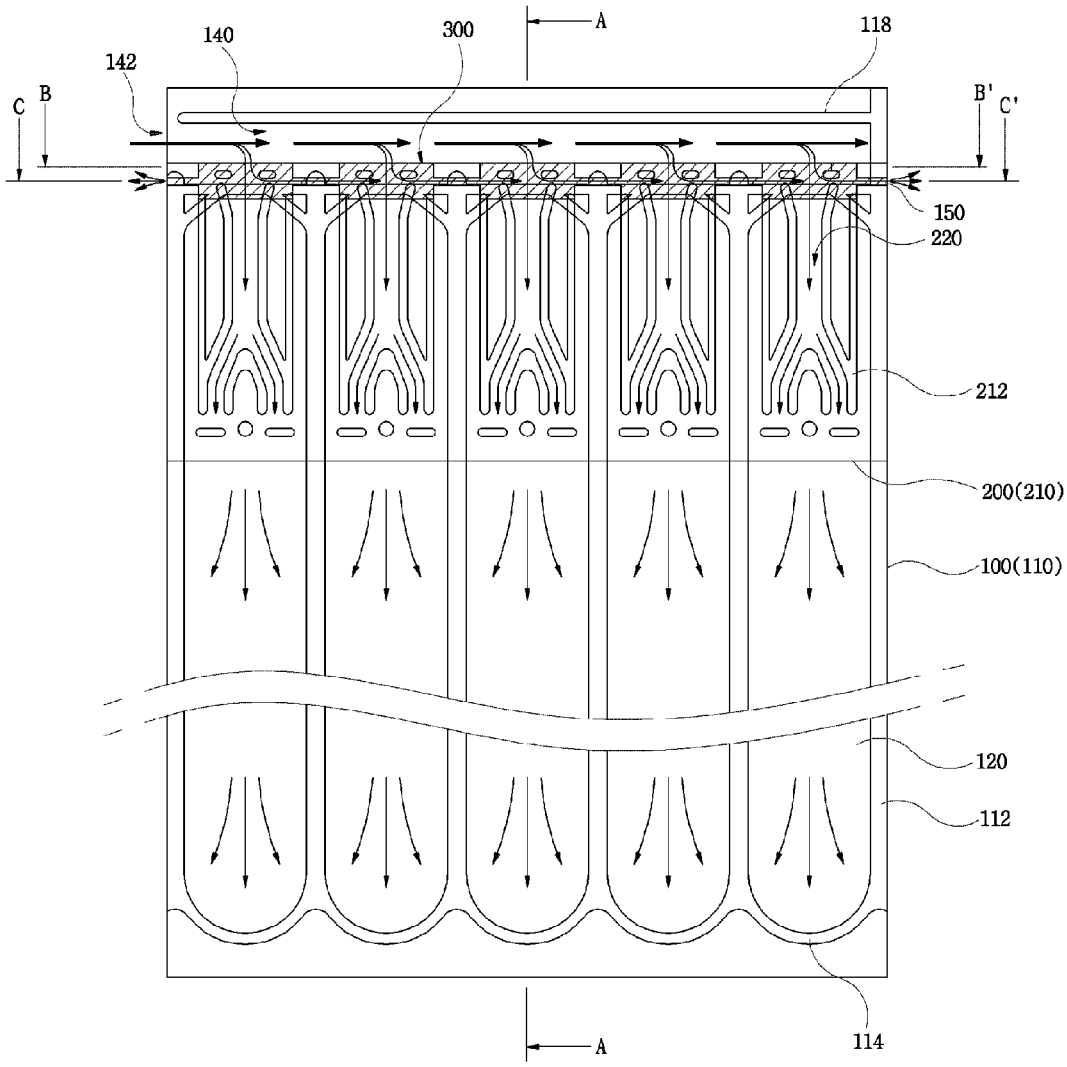
FIG. 5 is a schematic diagram showing how air is injected into the buffer packing material having an air injection path formed with a bypass according to the first embodiment of the present invention.
Figure 6:
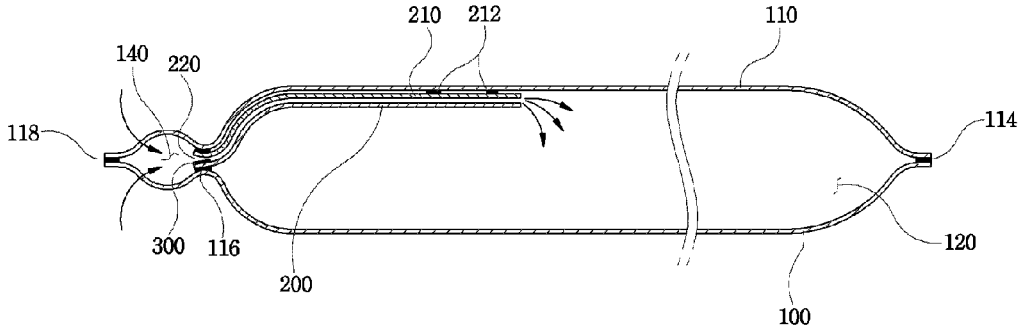
FIG. 6 is a sectional view taken along line A-A' of the buffer packing material shown in FIG. 5.
Figure 7:
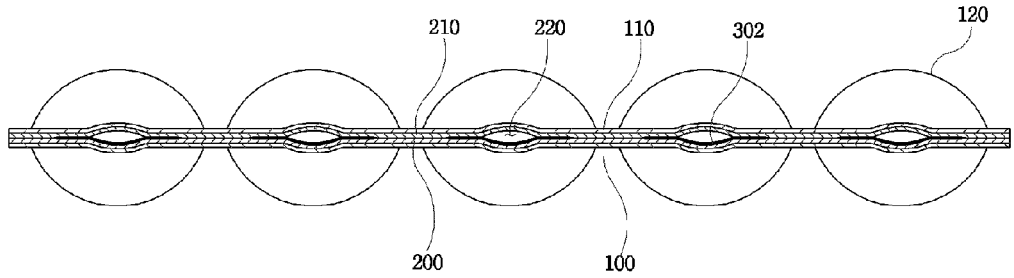
FIG. 7 is a sectional view taken along line B-B' of the buffer packing material shown in FIG. 5.
Figure 8:
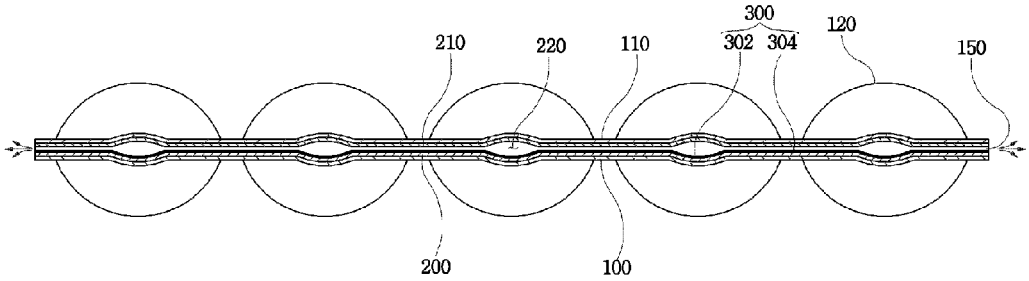
FIG. 8 is a sectional view taken along line C-C' of the buffer packing material shown in FIG. 5.

FIG. 5 is a schematic diagram showing how air is injected into the buffer packing material having an air injection path formed with a bypass according to the first embodiment of the present invention; FIG. 6 is a sectional view taken along line A-A' of the buffer packing material shown in FIG. 5; FIG. 7 is a sectional view taken along line B-B' of the buffer packing material shown in FIG. 5; and FIG. 8 is a sectional view taken along line C-C' of the buffer packing material shown in FIG. 5.

Referring to FIG. 5, if air is injected into the air injection path 140 through the air injection hole 142, the air is injected into the respective air cell 120 via the plurality of air guiding paths 220 connected to the air injection path 140. If the air cell 120 is sufficiently filled with the air, the overpressure air is discharged to the outside through the bypass 150 formed through both sides of the air guiding path 220.

Referring to FIG. 6, it is shown that the air injected into the air injection path 140 is introduced into the air cell 120 through the air guiding path 220 so that the air cell 120 expands.

Referring to FIG. 7, the configuration of the front end side of the air guiding paths 220 connected to the air injection path 140 is illustrated, wherein the upper and lower inner sheets 210 and 200 which define the air guiding paths 220 are fused to each other so that adjacent air guiding paths 220 are isolated from each other.

Referring to FIG. 8, it is shown that the passages connecting the air injection path 140 to the air guiding paths 220 communicate with the bypass 150 which connects the passages, and air is discharged to the outside through the bypass 150.

With this configuration, if the air injected into the air injection path 140 through the air injection hole 142 flows into the plurality of air guiding paths 220 connected to the air injection path 140 and thus the pressure in the air cell 120 excessively increases, the overpressure air is discharged to the outside through the bypass 150 to prevent the air from being excessively injected into a specific air cell and to prevent the outer sheet from being deformed or broken.

Figure 9:
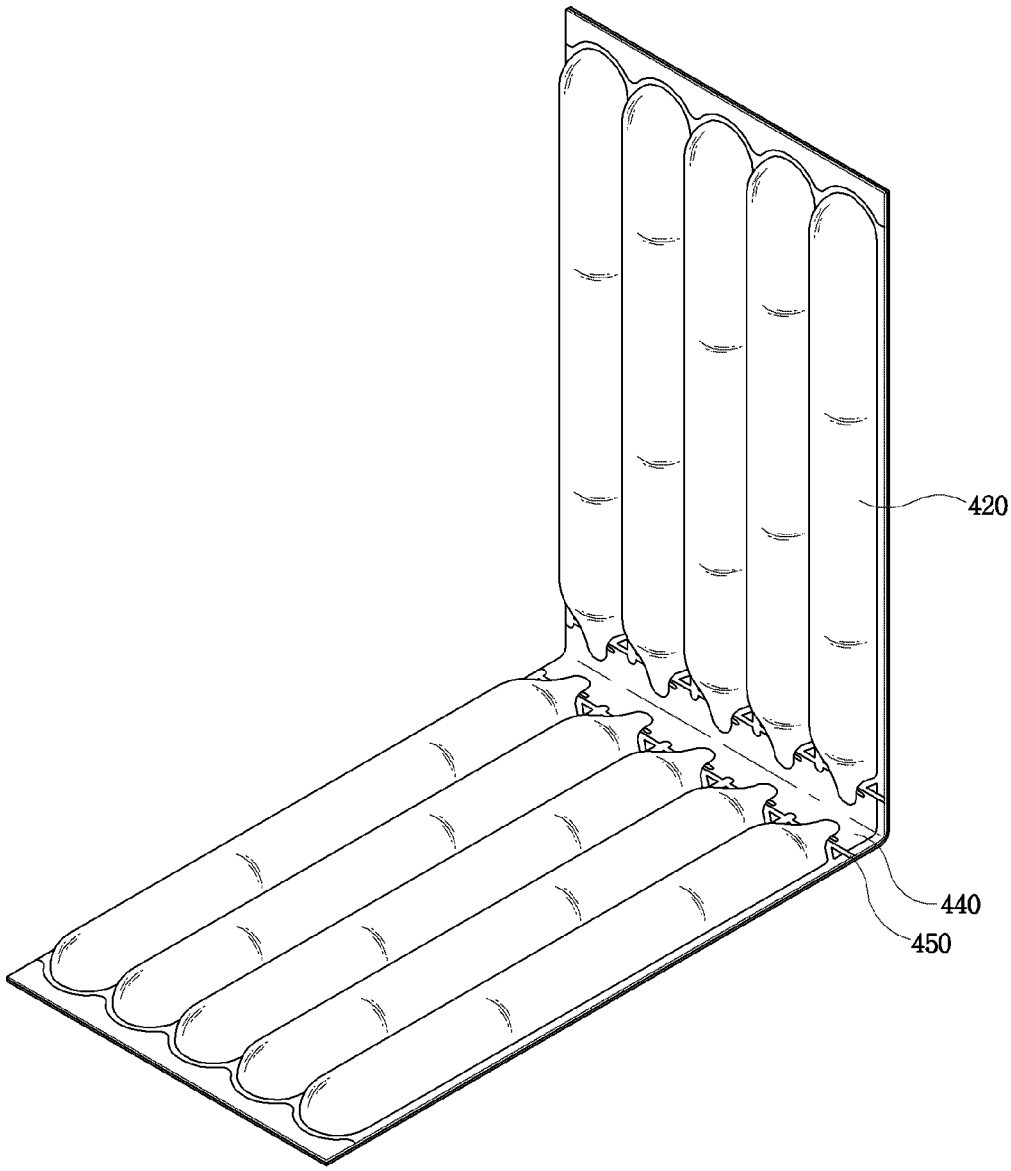
FIG. 9 is a perspective view showing a buffer packing material having an air injection path formed with a bypass according to a second embodiment of the present invention.
Figure 10:
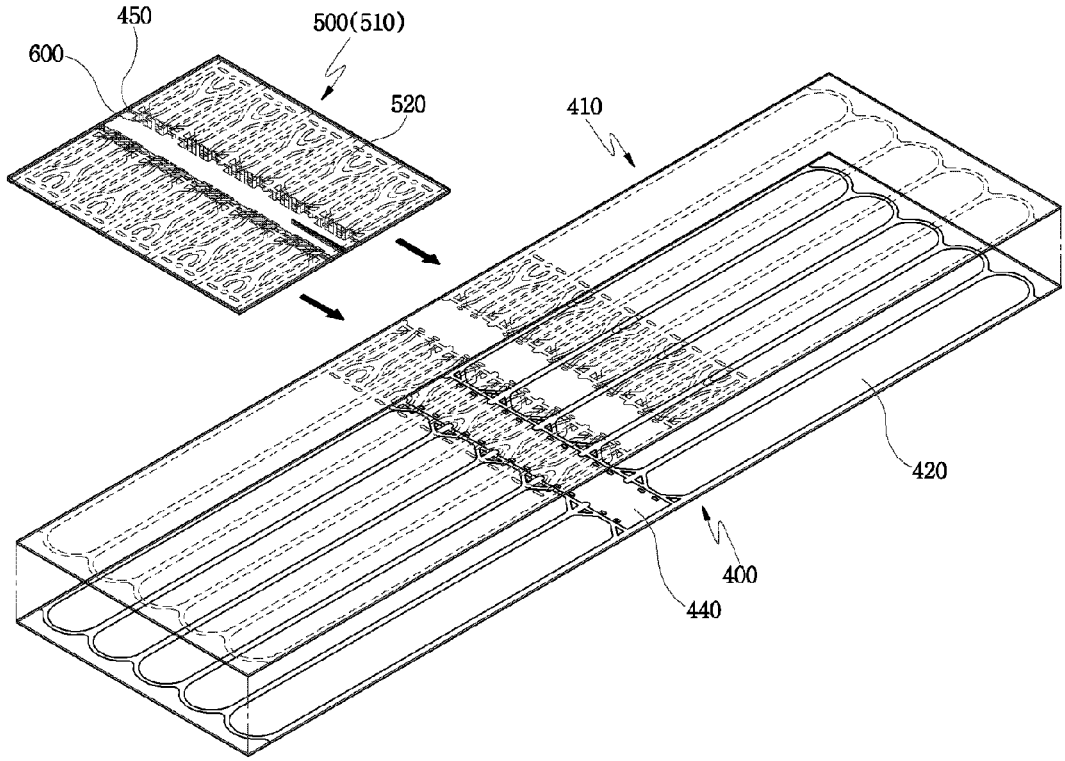
FIG. 10 is an exploded perspective view illustrating a process of manufacturing the buffer packing material having an air injection path formed with a bypass according to the second embodiment of the present invention.

FIG. 9 is a perspective view showing a buffer packing material having an air injection path formed with a bypass according to a second embodiment of the present invention; and FIG. 10 is an exploded perspective view illustrating a process of manufacturing the buffer packing material having an air injection path formed with a bypass according to the second embodiment of the present invention.

Referring to FIGS. 9 and 10, the buffer packing material having an air injection path formed with a bypass according to the second embodiment of the present invention is identical to that of the first embodiment, except that an air injection path 440 is formed across a central portion of an lower outer sheet 400 and an upper outer sheet 410, and that a lower inner sheet 500 and an upper inner sheet 510 having a plurality of air guiding paths 520 are inserted corresponding to the upper and lower portions of the air injection path 440 respectively and each air cell 420 has one air guiding path 520 so that the buffer packing material may be folded through the air injection path 440. Here, releasing bands 600, in each of which rectangular patterns defining passages which connect the air injection path 440 to the air guiding paths 520 and narrow strip patterns which define a bypass 450 connecting the passages are repeatedly alternately formed, are formed in the upper portion of the lower inner sheet 500.

The buffer packing material configured as above may be manufactured in the same manner as in the first embodiment. Here, a pair of releasing bands 600 spaced apart from each other across the central portion of the lower inner sheet 500 are formed, and in the process of inserting the upper and lower inner sheets 510 and 500 between the upper and lower outer sheets 410 and 400, a process of cutting the central portion of the upper and lower inner sheets 510 and 500, namely the portions between the pair of releasing bands 600, is added just before inserting the upper and lower inner sheets 510 and 500 between the upper and lower outer sheets 410 and 400.

As mentioned above, the reason why the central portion of the upper and lower inner sheets 510 and 500 is cut just before the upper and lower inner sheets 510 and 500 are inserted between the upper and lower outer sheets 410 and 400 is that the air guiding paths 520 formed between the upper and lower inner sheets 510 and 500 and the air cells 420 formed between the upper and lower outer sheets 410 and 400 may be aligned more accurately.

In other words, the pair of releasing bands 600 spaced apart from each other by a predetermined distance along the central portion are formed in the lower inner sheet 500. Here, as shown in FIG. 10, the central portion of the upper and lower inner sheets 510 and 500 is cut just before being inserted between the upper and lower outer sheets 410 and 400, so that it may minimize the distortion of alignment which may be caused by different tensions of the inner or outer sheet in the inserting process of the upper and lower outer sheets 410 and 400 and the upper and lower inner sheets 510 and 500 under tension. In this way, the patterns formed in the releasing bands 600 may be accurately aligned to the locations of the air cells 420, the air guiding paths 520, and the bypass 450, which is to decrease defects.

In addition, when the central portion of the upper and lower inner sheets 510 and 500, namely the portion between the pair of releasing bands 600, is cut, the upper and lower inner sheets 510 and 500 remaining between the pair of releasing bands 600 may be removed so that the pair of releasing bands 600 are located at one edge of the cut upper and lower inner sheets 510 and 500. Accordingly, the passages formed in the releasing bands 600 to connect the air injection path 440 and the air guiding paths 520 is directly connected to the air injection path 440 so that the air injected through the air injection path 440 may smoothly flow into the air guiding paths 520.

Although the present invention has been described and illustrated in connection with the specific embodiments as described above, it will be readily understood that various modifications can be made thereto without departing from the scope of the present invention. Therefore, the scope of the present invention is not limited to the embodiments described above but is defined by the appended claims and the equivalents thereto.

INDUSTRIAL APPLICABILITY

The buffer packing material having an air injection path formed with a bypass according to the present invention discharges overpressure air through the bypass when air is injected into air cells, which prevents the package from being deformed or broken. The buffer packing material may also be applied to various distribution industries to protect products.

The invention claimed is:

1. A buffer packing material having an air injection path formed with a bypass, comprising:

(a) a lower outer sheet;

(b) a lower inner sheet overlapping with an upper portion of the lower outer sheet so that a releasing band is formed in an upper portion of the lower inner sheet in a transverse direction along a front edge thereof;

(c) an upper inner sheet overlapping with the upper portion of the lower inner sheet and partially fused with the lower inner sheet to form a plurality of air guiding paths;

(d) an upper outer sheet overlapping with the upper portions of the upper inner sheet and the lower outer sheet and partially fused with the upper inner sheet, the lower inner sheet and the lower outer sheet to:

form longitudinal fusion portions at regular intervals to define a plurality of spaced apart air cells in series in a transverse direction, an air guiding path in air flow communication with each air cell, and simultaneously to form an air injection path at front ends of the plurality of air cells, said air injection path in air flow communication with the plurality of air guiding paths; and (e) wherein the said releasing band formed at the front end of the upper portion of the lower inner sheet is configured to define:

a plurality of passages, the passages being formed at positions where the air injection path is connected to the air guiding paths and where the air injection path is in air flow communication with the air guiding paths, and a bypass, the bypass being sections that interconnect the plurality of passages and that are in air flow communication with the plurality of passages, wherein at least one end of one section of the bypass is in communication with the ambient, whereby if air is excessively injected into the air injection path, the overpressure air in the air injection path is discharged to the ambient through the bypass to control the internal pressure of the air injection path and the internal pressure of the plurality of air cells.

2. The buffer packing material as claimed in claim 1, wherein the upper inner sheet is configured to be into close contact with the upper outer sheet.

3. The buffer packing material as claimed in claim 1, wherein the releasing band is formed by alternating rectangular or oval patterns defining a plurality of passages respectively connected to the plurality of air guiding paths and narrow-strip patterns defining the bypass connecting the plurality of passages with each other.

4. The buffer packing material as claimed in claim 1, wherein the releasing band has a plurality of through-holes formed in a bar pattern at regular intervals, a plurality of passages connecting the air injection path to the plurality of air guiding paths are formed in a region of the releasing band where no through-hole is are formed, and the bypass for connecting the plurality of passages to each other is formed in a region of the releasing band where the through-holes are formed.

5. The buffer packing material as claimed in claim 1, wherein the bypass is formed to have a size of 0.1% to 20% of a width of the air injection path.

6. The buffer packing material as claimed in claim 1, wherein the lower outer sheet and the upper outer sheet are made of any one of high density polyethylene (hard polyethylene), nylon, and PET (polyethyleneterephthalate).

7. The buffer packing material as claimed in claim 6, wherein an anti-rust material for controlling the generation of rust of an article to be packaged or an anti-charging material for preventing the generation of static electricity is added to the lower outer sheet and the upper outer sheet.

8. The buffer packing material as claimed in claim 6, wherein an anti-rust film or an anti-charging film laminated on a surface or both surfaces of each of the lower outer sheet and the upper outer sheet.

* * * * *